US011540633B2

(12) United States Patent
Zhang

(10) Patent No.: US 11,540,633 B2
(45) Date of Patent: Jan. 3, 2023

(54) CHAIR FRAME MECHANISM AND CHAIR HAVING THE SAME

(71) Applicant: Xiaozhao Zhang, Chuzhou (CN)

(72) Inventor: Xiaozhao Zhang, Chuzhou (CN)

( * ) Notice: Subject to any disclaimer, the term of this patent is extended or adjusted under 35 U.S.C. 154(b) by 0 days.

(21) Appl. No.: 17/349,860

(22) Filed: Jun. 16, 2021

(65) Prior Publication Data

US 2022/0071397 A1 Mar. 10, 2022

(30) Foreign Application Priority Data

Sep. 8, 2020 (CN) ..... 202021949666.9

(51) Int. Cl.

| | |
|---|---|
| ***A47C 1/035*** | (2006.01) |
| ***A47C 1/031*** | (2006.01) |
| ***A47C 1/0355*** | (2013.01) |
| ***A47C 7/56*** | (2006.01) |

(52) U.S. Cl.

CPC ..... *A47C 1/0355* (2013.01); *A47C 7/563* (2013.01)

(58) Field of Classification Search

CPC ... A47C 1/0355; A47C 1/0345; A47C 1/0352; A47C 3/027; A47C 1/035; Y10S 297/07

See application file for complete search history.

(56) References Cited

U.S. PATENT DOCUMENTS 5,217,276 A * 6/1993 LaPointe ..... A47C 1/0355 297/85 L
2005/0140183 A1* 6/2005 Conte ..... A47C 1/0352 297/68
2011/0175404 A1* 7/2011 Lawson ..... A47C 3/027 297/83
2011/0175426 A1* 7/2011 Lawson ..... A47C 1/0355 297/85 M
2011/0181094 A1* 7/2011 Lawson ..... A47C 1/035 297/85 R
2011/0193373 A1* 8/2011 Lawson ..... A47C 1/029 297/71
2012/0049606 A1* 3/2012 Lawson ..... A47C 1/0342 74/521
2012/0068508 A1* 3/2012 LaPointe ..... A47C 7/50 297/284.8
2014/0021760 A1* 1/2014 Masters ..... A47C 1/0355 297/313
2014/0049084 A1* 2/2014 Lawson ..... A47C 7/24 297/340

(Continued)

*Primary Examiner* — Shin H Kim

(57) ABSTRACT

A chair frame mechanism and a chair having the same are provided. The chair frame mechanism includes a movable component, a chair bracket, a leg component, a back component and a sequence component. The movable component is connected with the chair bracket. The leg component and the back component are pivotally connected with the chair bracket, respectively, and the back component is connected with the movable component. The sequence component is connected with the movable component and the chair bracket, respectively, and connected with the leg component and the back component by transmission, respectively. The sequence component is capable of controlling the chair bracket to move relative to the movable component along a preset trajectory, and orderly controlling the leg component and the back component to extend or fold relative to the chair bracket.

18 Claims, 11 Drawing Sheets

(56) References Cited

U.S. PATENT DOCUMENTS

| | | | | |
|---|---|---|---|---|
| 2016/0029800 | A1* | 2/2016 | Bryant | A47C 1/0242<br>297/284.3 |
| 2019/0350362 | A1* | 11/2019 | Lapointe | A47C 1/034 |
| 2022/0071397 | A1* | 3/2022 | Zhang | A47C 1/03211 |

* cited by examiner

CHAIR FRAME MECHANISM AND CHAIR HAVING THE SAME

CROSS-REFERENCE TO RELATED APPLICATIONS

This application claims all benefits accruing under 35 U.S.C. § 119 from China Patent Application No. 202021949666.9, filed on Sep. 8, 2020, titled "CHAIR FRAME MECHANISM AND CHAIR HAVING THE SAME" in the China National Intellectual Property Administration, the content of which is hereby incorporated by reference.

TECHNICAL FIELD

The present disclosure generally relates to chairs, and in particular, to a chair frame mechanism and a chair having the same.

BACKGROUND

A chair frame mechanism is a mechanical device disposed in a chair or a sofa, which can adjust a shape of the chair or the sofa and change states of different parts by corresponding mechanical drive and transmission, so as to meet various requirements of a user. For example, the chair frame mechanism is provided with a leg component and a back component capable of moving and changing respective positional states.

A conventional chair frame mechanism can adjust the state or the position of the leg component or the back component by setting a driving component and adding a single power source. However, a structure used to realize a power transmission in the chair frame mechanism is complex, and a chair bracket, the leg component and the back component often move and switch positions and states at the same time, resulting in increasing discomfort of the user, and even leading to collision interference among various components. Therefore, it is difficult to meet actual requirements of the user and the use experience of the product is poor.

SUMMARY

The present disclosure provides a chair frame mechanism including a movable component, a chair bracket, a leg component, a back component and a sequence component. The movable component is connected with the chair bracket, the leg component and the back component are pivotally connected with the chair bracket, respectively, and the back component is connected with the movable component. The sequence component is connected with the movable component and the chair bracket, respectively, and connected with the leg component and the back component by transmission, respectively. The sequence component is capable of controlling the chair bracket to move relative to the movable component along a preset trajectory, and orderly controlling the leg component and the back component to extend or fold relative to the chair bracket.

In some embodiments, the movable component includes an adjusting mechanism for different sitting postures and a lifting mechanism, and the adjusting mechanism for sitting postures is pivotally connected with the lifting mechanism and the chair bracket, respectively. The sequence component includes a swing controlling element and a sequence connecting rod. The swing controlling element is pivotally connected with the adjusting mechanism for sitting postures, connected with the back component by transmission via the adjusting mechanism for sitting postures, and movably connected with the chair bracket. A first end of the sequence connecting rod is pivotally connected to the swing controlling element, and a second end of the sequence connecting rod is connected with the leg component by transmission. The adjusting mechanism for sitting postures is capable of moving and driving the chair bracket to move relative to the lifting mechanism; the sequence connecting rod is capable of moving in association with the leg component, and the swing controlling element is capable of moving relative to the adjusting mechanism for sitting postures when driven by the sequence connecting rod, resulting in controlling the chair bracket to move relative to the adjusting mechanism for sitting postures along the preset trajectory.

In this way, the sequence component can move in association with the leg component, and move in association with the chair bracket and the back component by the adjusting mechanism for sitting postures, so as to associate motion of the leg component, the chair bracket and the back component, resulting in that the sequence component can control the moving trajectory of the chair bracket and an operation order of the leg component and the back component.

In some embodiments, one of the swing controlling element and the chair bracket is provided with a guide groove, the other one of the swing controlling element and the chair bracket is provided with a guide block sliding with the guide groove, and the guide groove is defined as the preset trajectory for the sliding of the guide block, resulting in controlling the chair bracket to move relative to the adjusting mechanism for sitting postures along the preset trajectory.

In this way, the chair bracket can move relative to the adjusting mechanism for sitting postures along the preset trajectory in the restriction of the guide groove.

In some embodiments, the guide groove includes a first guide portion and a second guide portion that are communicated with each other, and the guide block can continuously slide from one of the first guide portion and the second guide portion to the other one. In a process of the guide block sliding in the first guide portion, the swing controlling element can control the leg component to extend or fold relative to the chair bracket, and control the back component to fix relative to the chair bracket. In a process of the guide block sliding in the second guide portion, the swing controlling element can control the back component to extend or fold relative to the chair bracket, and control the leg component to fix relative to the chair bracket.

In this way, in the overall extending process of the chair frame mechanism, the leg component can move prior to the back component and extend relative to the chair bracket. At the same time, in the overall folding process of the chair frame mechanism, the back component can move prior to the leg component and fold relative to the chair bracket.

In some embodiments, the first guide portion is in a circular arc shape having a center, which is a pivot point between the swing controlling element and the adjusting mechanism for sitting postures.

In this way, the first guide portion in a circular arc shape can avoid a movement of the chair bracket relative to the fourth movable connecting rod when the guide block slides in the first guide portion, so as to avoid a movement of a second four-bar mechanism and a further movement of the first four-bar mechanism, resulting in avoiding a movement of the back component relative to the chair component. Finally, the back component is fixed relative to the chair bracket when the leg component moves relative to the chair bracket, i.e., the extending of the leg component relative to the chair bracket precedes the extending of the back component relative to the chair bracket.

In some embodiments, the second guide portion is in a straight line shape, and the straight line and a pivot point between the swing controlling element and the adjusting mechanism for sitting postures are collinear.

In this way, a rotation of the swing controlling element relative to the chair bracket is limited when the back component moves relative to the chair bracket, thus allowing the leg component to maintain to be fixed with the chair bracket. Finally, the leg component is fixed relative to the chair bracket when the back component moves relative to the chair bracket, i.e., the folding of the back component relative to the chair bracket precedes the folding of the leg component relative to the chair bracket.

In some embodiments, the back component includes a first back element and a second back element. The first back element is pivotally connected with the chair bracket and the second back element, respectively. An end away from the first back element of the second back element is pivotally connected with the adjusting mechanism for sitting postures, and connected with the swing controlling element by transmission via the adjusting mechanism for sitting postures. The chair bracket, the first back element, the second back element and the adjusting mechanism for sitting postures form a first four-rod mechanism.

In this way, the back component has a definite moving trajectory, so the back component is more reliable and stable, not prone to failure in the process of repeated use.

In some embodiments, the back component further includes a back elastic member, and the back elastic member is connected with the chair bracket and the adjusting mechanism for sitting postures, respectively. The back elastic member can control an extending or folding process of the first back element relative to the chair bracket.

In this way, the back elastic member can play a role of buffering the first four-bar mechanism, resulting in a deformation process of the back component slower and more relaxed when the back of the user presses on the back component, thus improving a comfort of the user and avoiding the imbalance caused by the press of the back.

In some embodiments, the adjusting mechanism for sitting postures includes a first movable connecting rod, a second movable connecting rod, a third movable connecting rod, a fourth movable connecting rod and a fifth movable connecting rod. Two ends of the first movable connecting rod are pivotally connected with the lifting mechanism and the second movable connecting rod, respectively. Two ends of the fifth movable connecting rod are pivotally connected with the lifting mechanism and the fourth movable connecting rod, respectively. Two ends of the third movable connecting rod are pivotally connected with the second movable connecting rod and the fourth movable connecting rod, respectively. The fourth movable connecting rod is pivotally connected with the swing controlling element. The chair bracket is pivotally connected with the second movable connecting rod and the fourth movable connecting rod, respectively, and the chair bracket, the second movable connecting rod, the third movable connecting rod and the fourth movable connecting rod form a second four-bar mechanism.

In this way, the adjusting mechanism for sitting postures can extend or fold relative to the lifting mechanism, resulting in driving the chair bracket to move relative to the lifting mechanism to realize the adjustment for the sitting postures of the user.

In some embodiments, the lifting mechanism comprises a first base plate, a first lifting connecting rod, a second lifting connecting rod and a bottom connecting rod. The bottom connecting rod is pivotally connected with the adjusting mechanism for sitting postures, and the first base plate is pivotally connected with the first lifting connecting rod and the second lifting connecting rod, respectively. An end away from the first base plate of the first lifting connecting rod is pivotally connected with the bottom connecting rod, and an end away from the first base plate of the second lifting connecting rod is pivotally connected with the bottom connecting rod. The first base plate, the first lifting connecting rod, the second lifting connecting rod and the bottom connecting rod form a third four-bar mechanism.

In this way, the lifting mechanism can produce a deformation defined by the moving trajectory, so as to lift or fall the chair bracket together with the leg component, the back component and the adjusting mechanism for sitting postures, resulting in facilitating the user to leave or use the chair.

The present disclosure further provides a chair. The chair includes a base and the chair frame mechanism as described above. The chair frame mechanism is connected with the base by the movable component.

In some embodiments, the chair further includes a driving component. The driving component is connected with the base, and connected with the movable component, the sequence component, the leg component and the back component by transmission, respectively. The driving component can drive the movable component to move relative to the base, and drive the leg component or the back component to extend or fold relative to the chair bracket. The leg component can move in association with the sequence component when driven by the driving component, resulting in controlling the chair bracket to move relative to the movable component along the preset trajectory.

In this way, the chair can be operated by a way of electrically controlled driving, and the adjustment for sitting postures, the leg support and the back support is quicker, labor-saving and easy to operate.

In some embodiments, the chair further includes a transmission component. The transmission component includes a power output member, and the power output member is connected with the driving component and the movable component by transmission, respectively, and pivotally connected with the leg component and the sequence component. The power output member can drive the leg component to extend or fold relative to the chair bracket when driven by the driving component, and drive the sequence component to move relative to the movable component, resulting in controlling the chair bracket to move relative to the movable component along the preset trajectory.

In this way, the power output member can receive the power generated by the driving component to drive the leg component to extend or fold, and control the movement of the adjustment mechanism for sitting postures and the chair bracket indirectly. The transmission component has high transmission efficiency and less power loss as a whole.

In some embodiments, the transmission component further includes a first mechanism of transmission connecting rod and a second mechanism of transmission connecting rod. The first mechanism of transmission connecting rod includes a first transmission connecting rod, a second transmission connecting rod, a third transmission connecting rod and a fourth transmission connecting rod. The first mechanism of transmission connecting rod can drive the power output member to move when driven by the driving component, resulting in driving the leg component and the sequence component to move. The first transmission connecting rod is pivotally connected with the movable component, and connected with the driving component. Two ends of the second transmission connecting rod are pivotally connected with the first transmission connecting rod and the third transmission connecting rod, respectively. Two ends of the fourth transmission connecting rod are pivotally connected with the third transmission connecting rod and the power output member, respectively. The second mechanism of transmission connecting rod comprises a fifth transmission connecting rod and a sixth transmission connecting rod. The second mechanism of transmission connecting rod can drive the movable component to move when driven by the power output member. Two ends of the fifth transmission connecting rod are pivotally connected with the power output member and the sixth transmission connecting rod, respectively. An end away from the fifth transmission connecting rod of the sixth transmission connecting rod is pivotally connected with the movable component.

In some embodiments, a number of the chair frame mechanism is two sets, and the two sets of the chair frame mechanism are symmetrically disposed relative to the base and can move in association with each other.

In this way, a support effect of chair frame mechanism is better, and it is more convenient to arrange a covering or other structural parts used for support outside the chair frame mechanism.

The present disclosure provides the chair frame mechanism. By disposing the sequence component, the chair frame mechanism has the definite moving trajectory, and a position change and a state change of the leg component and the back component can be carried out in a preset sequence. Thus, the leg component and the back component are extended or folded step by step relative to the chair bracket, avoiding a disordered or simultaneous movement of the leg component and the back component, resulting in preventing bad operation conditions such as collision interference in the chair frame mechanism. In addition, the leg component and the back component move respectively to achieve an adjustment for leg support and an adjustment for back support in order, resulting in preventing a tension of the user caused by a simultaneous adjustment of leg support and back support. The movement of the leg component and the back component conforms to the ergonomic design concept. Therefore, it not only meets the requirements of the user for adjusting the sitting postures, but also improves the use experience of the chair.

In the figures, 100 represents an chair frame mechanism; 10 represents a movable component; 11 represents an adjusting mechanism for sitting postures; 111 represents a first movable connecting rod; 112 represents a second movable connecting rod; 113 represents a third movable connecting rod; 114 represents a fourth movable connecting rod; 115 represents a fifth movable connecting rod; 12 represents a lifting mechanism; 121 represents a second base plate; 1211 represents a sliding groove; 122 represents a first lifting connecting rod; 123 represents a second lifting connecting rod; 124 represents a bottom connecting rod; 125 represents a first base plate; 20 represents a chair bracket; 30 represents a leg component; 40 represents a back component; 41 represents a first back element; 42 represents a second back element; 43 represents a back elastic member; 50 represents a sequence component; 51 represents a sequence connecting rod; 52 represents a swing controlling element; 53 represents a guide groove; 531 represents a first guide portion; 532 represents a second guide portion; 54 represents a guide block; 61 represents a locking connecting rod; 62 represents a locking arm; 63 represents a locking elastic member; 64 represents a locking limiting member; 200 represents a chair; 210 represents a base; 220 represents a driving component; 221 represents a driving element; 2211 represents a push rod; 2212 represents a motor shell; 222 represents a first driving beam; 2221 represents a U-shaped seat; 2222 represents a fan-shaped plate; 2223 represents a first pivot; 2224 represents a second pivot; 230 represents a transmission component; 231 represents a power output member; 2321 represents a first transmission connecting rod; 2322 represents a second transmission connecting rod; 2323 represents a third transmission connecting rod; 2324 represents a fourth transmission connecting rod; 2331 represents a fifth transmission connecting rod; 2332 represents a sixth transmission connecting rod.

DETAILED DESCRIPTION OF THE EMBODIMENT

The technical solutions in the embodiments of the present disclosure are clearly and completely described in the following with reference to the accompanying drawings in the embodiments of the present disclosure. It is obvious that the described embodiments are only a part of the embodiments, but not all of the embodiments. All other embodiments obtained by those skilled in the art based on the embodiments of the present disclosure without departing from the inventive scope are the scope of the present disclosure.

Unless otherwise defined, all technical and scientific terms used herein have the same meaning as a skilled person in the art would understand. The terminology used in the description of the present disclosure is for the purpose of describing particular embodiments and is not intended to limit the disclosure. The term "or/and" as used herein includes any and all combinations of one or more of the associated listed items.

Figure 1:
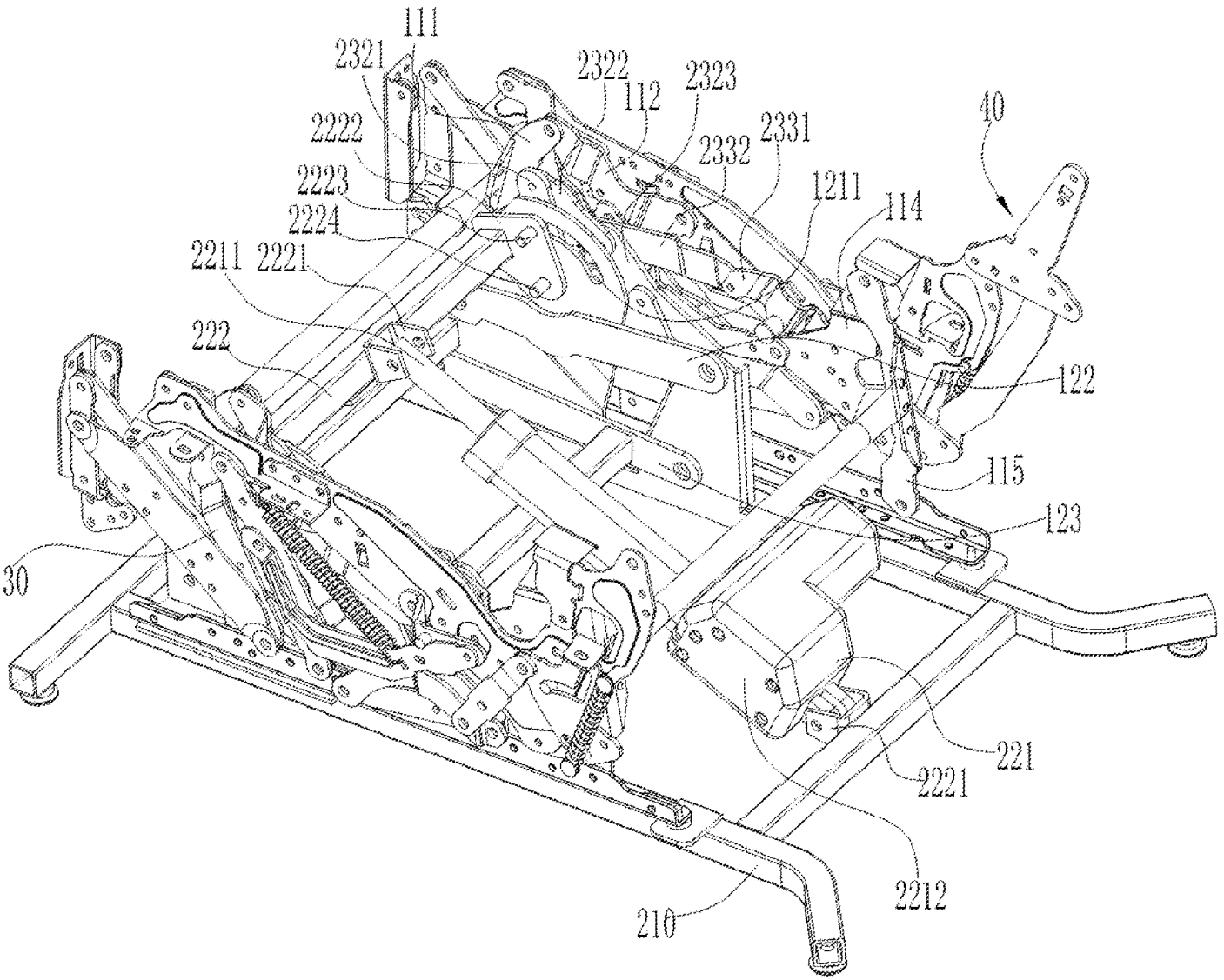
FIG. 1 is a structural schematic view of a chair in a folding state in an embodiment of the present disclosure.
Figure 2:
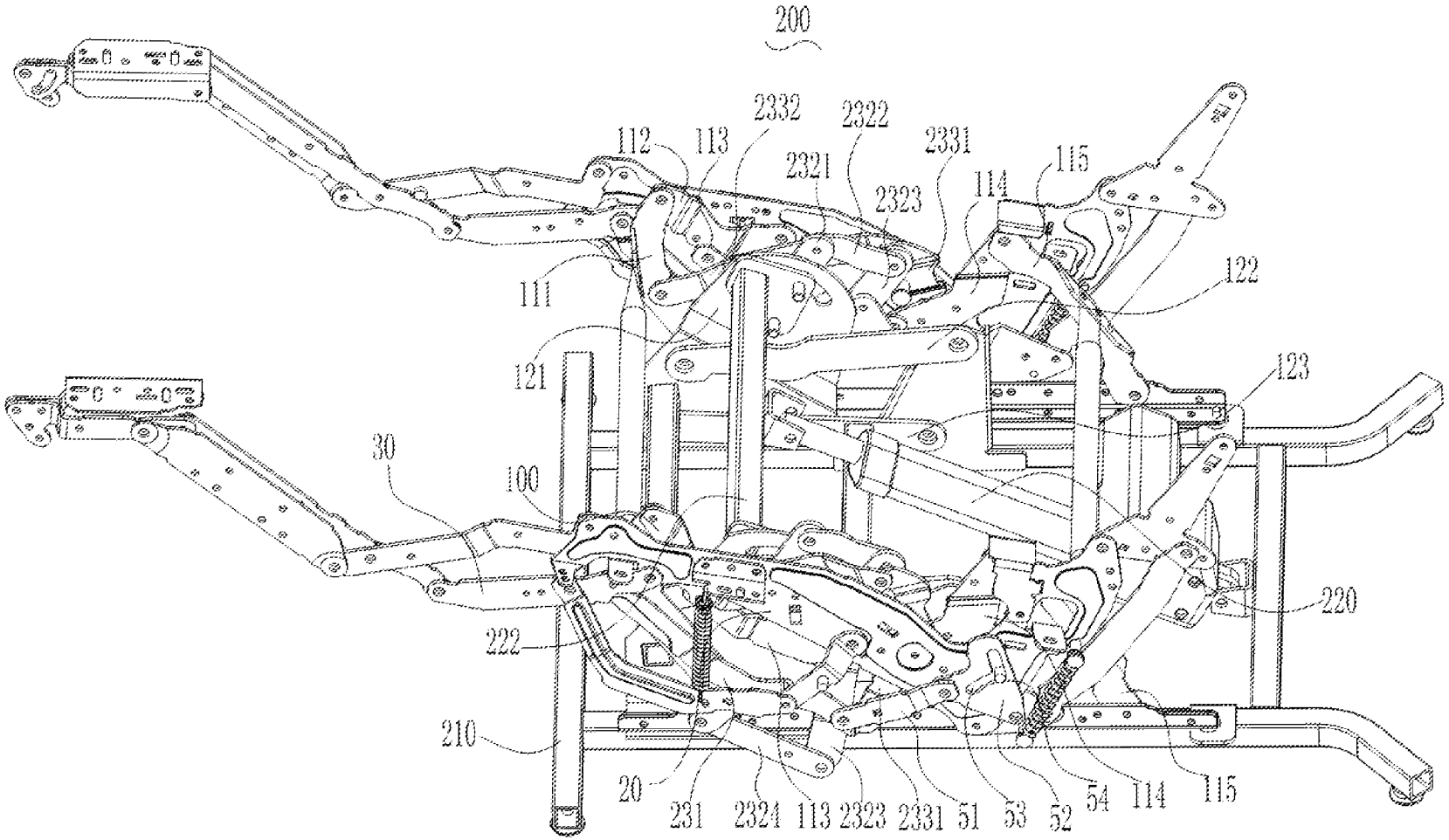
FIG. 2 is a structural schematic view of a chair in a partially extending state in another embodiment of the present disclosure.
Figure 3:
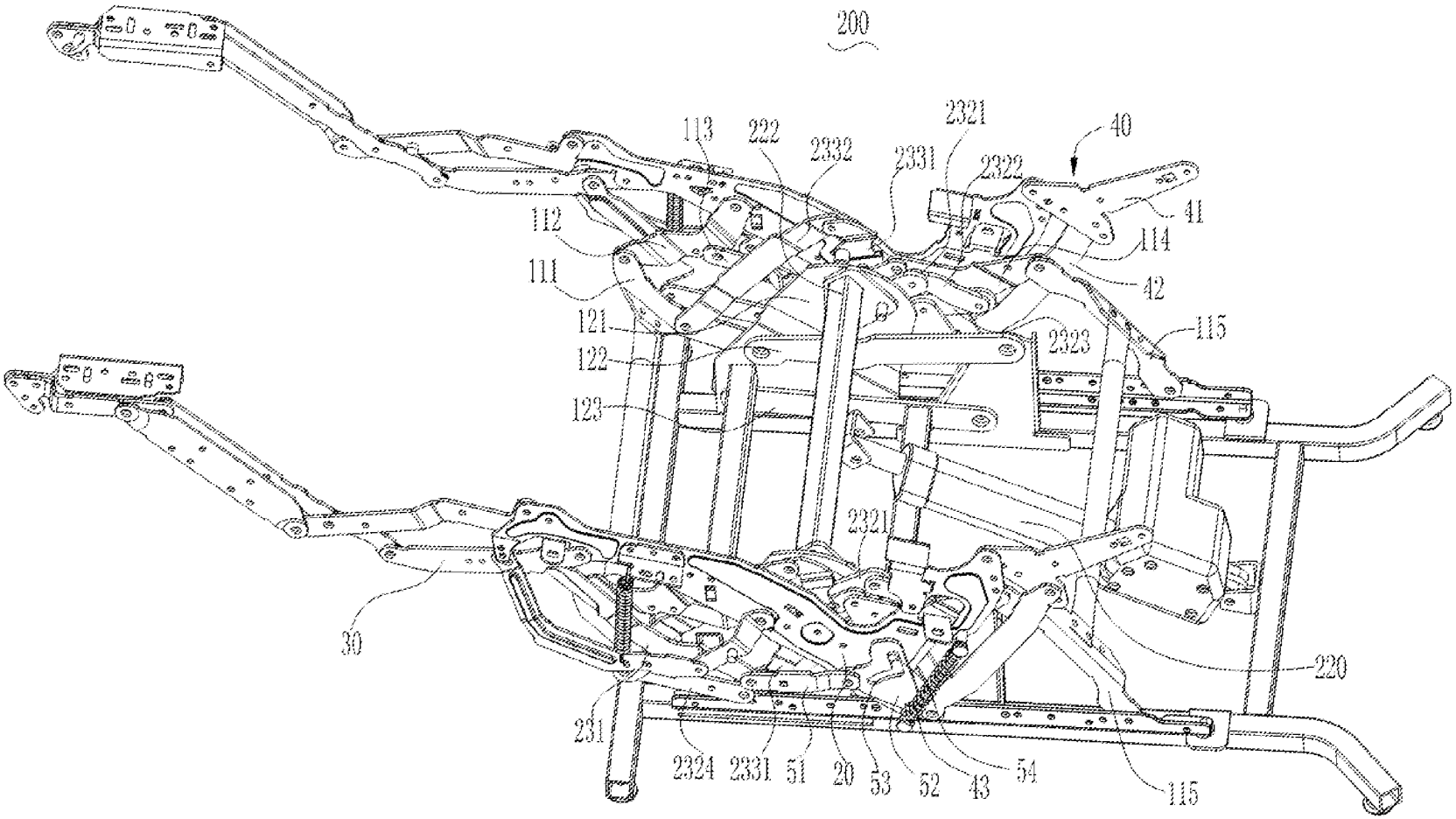
FIG. 3 is a structural schematic view of a chair in a fully extending state in another embodiment of the present disclosure.
Figure 4:
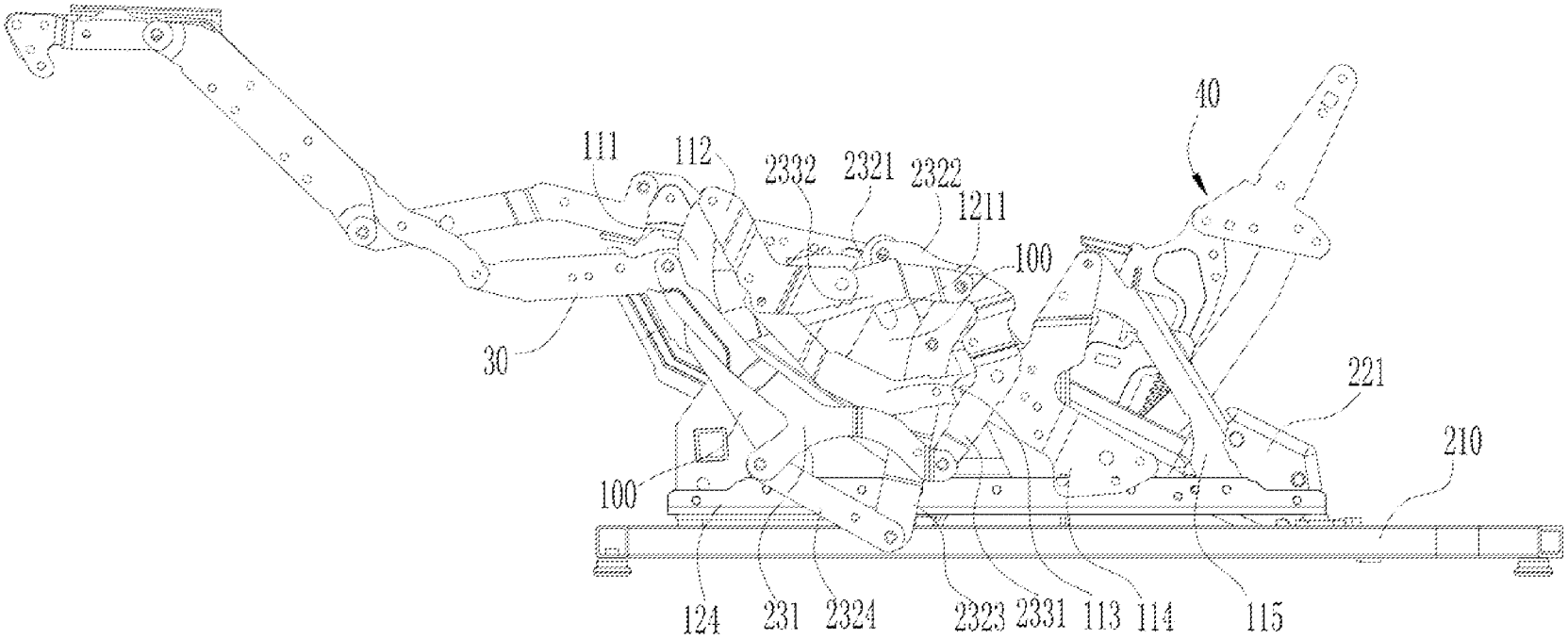
FIG. 4 is a structural schematic view of part of the structure of the chair of FIG. 2.

FIG. 1 is a structural schematic view of a chair 200 in a folding state in an embodiment of the present disclosure. FIG. 2 is a structural schematic view of a chair 200 in a partially extending state in another embodiment of the present disclosure. FIG. 3 is a structural schematic view of a chair 200 in a fully extending state in another embodiment of the present disclosure. FIG. 4 is a structural schematic view of part of the structure of the chair 200 of FIG. 2.

A chair frame mechanism 100 is a mechanical device disposed in the chair 200 or a sofa. By a corresponding mechanical drive and transmission, a shape adjustment of the chair 200 or the sofa, as well as state changes of different parts of the chair 200 or the sofa can be achieved, resulting in meeting various requirements of the user.

The present disclosure provides the chair frame mechanism 100 and the chair 200 having the same. The chair frame mechanism 100 is disposed in the chair 200 to form a support and movement skeleton of the chair 200. It can be wrapped with a covering or added with a filling object and a structural part outside the chair frame mechanism 100, resulting in that the chair 200 can be used by the user for resting. The chair frame mechanism 100 includes a movable component 10, a chair bracket 20, a leg component 30 and a back component 40.

It can be understood that the chair frame mechanism 100 provided in the present disclosure can be driven by a driving component 220, which is disposed in the chair 200 and connected with the chair frame mechanism 100. The state of the chair frame mechanism 100 can be changed by a way of electric control driving, and the state of the chair frame mechanism 100 can also be changed by the user through a way of manual driving. Therefore, it does not be specially limited that the chair 200 is driven by the electric control driving or the manual driving, and it can be either of two driving ways.

Specially, in some embodiments of the present disclosure, the chair frame mechanism 100 can be operated in the way of electric control driving by disposing a driving component 220 in the chair 200. The chair 200 is provided with a fixed base 210. The driving component 220 is connected with the base 210, and connected with the movable component 10, the leg component 30 and the back component 40 by transmission, respectively. The driving component 220 can drive the movable component 10 to move relative to the base 210, and drive the leg component 30 or the back component 40 to extend or fold relative to the chair bracket 20.

It should be noted that the transmission connection described above and the transmission connection hereinafter referred to in the present disclosure mean that one of two components or two mechanisms indirectly realizes a connection with the other one of two components or two mechanisms and can transfer force or speed to the other one of two components or two mechanisms by connecting with other components or mechanisms.

For the convenience of description, the driving component 220 is disposed in the chair 200, and the motion of the chair frame mechanism 100 is driven by the way of electric control driving as an example. The way of manual driving to change the state of the chair frame mechanism 100 is not repeated here.

The movable component 10 is connected with the base 210 of the chair 200 and configured to connect and support the chair bracket 20. The movable component 10 can move and drive a movement of the chair bracket 20 to adjust a sitting posture angle and a position of the chair bracket 20, so as to meet various requirements of the user for the sitting posture of the chair 200 and to realize the overall lifting of the chair bracket 20, resulting in that the user gets up and leaves the chair 200 easily, especially for the elderly people to leave the chair 200.

Figure 5:
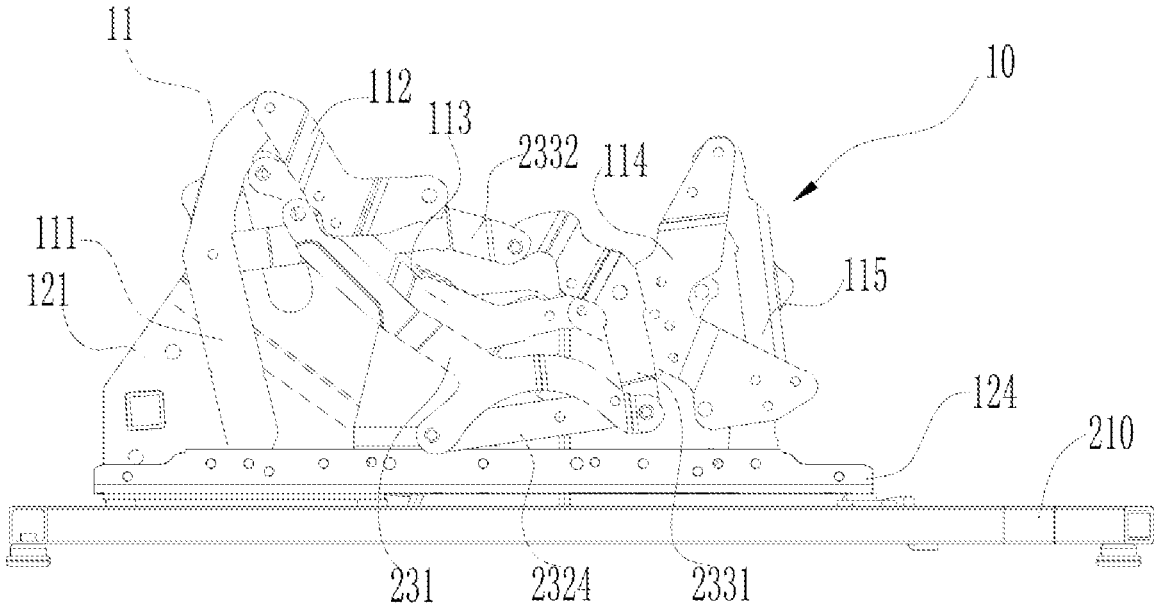
FIG. 5 is a structural schematic view of a movable component in a folding state in another embodiment of the present disclosure.
Figure 6:
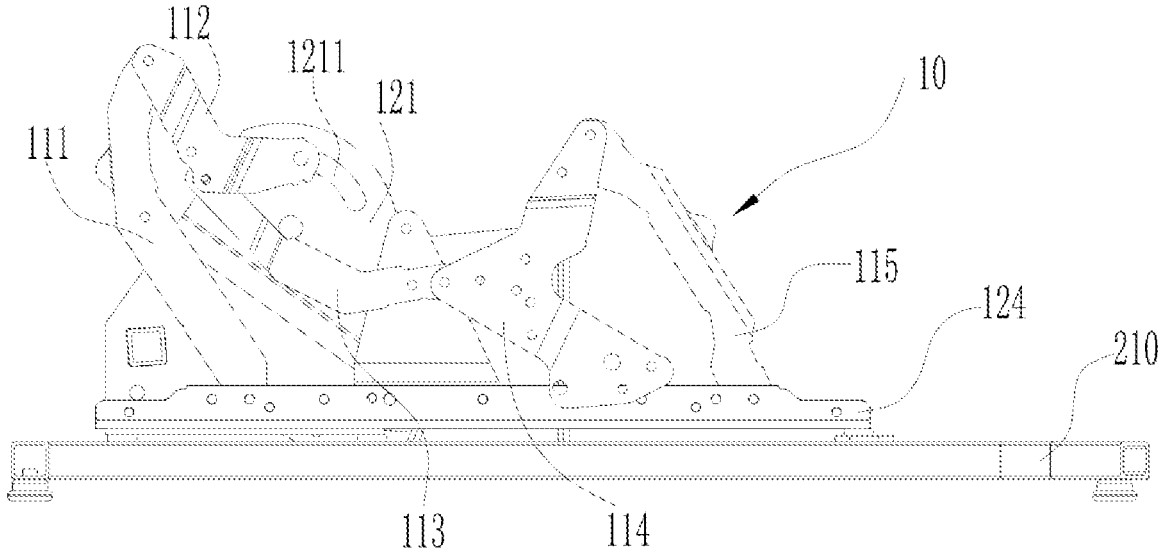
FIG. 6 is a structural schematic view of a movable component in a partially extending state in another embodiment of the present disclosure.
Figure 7:
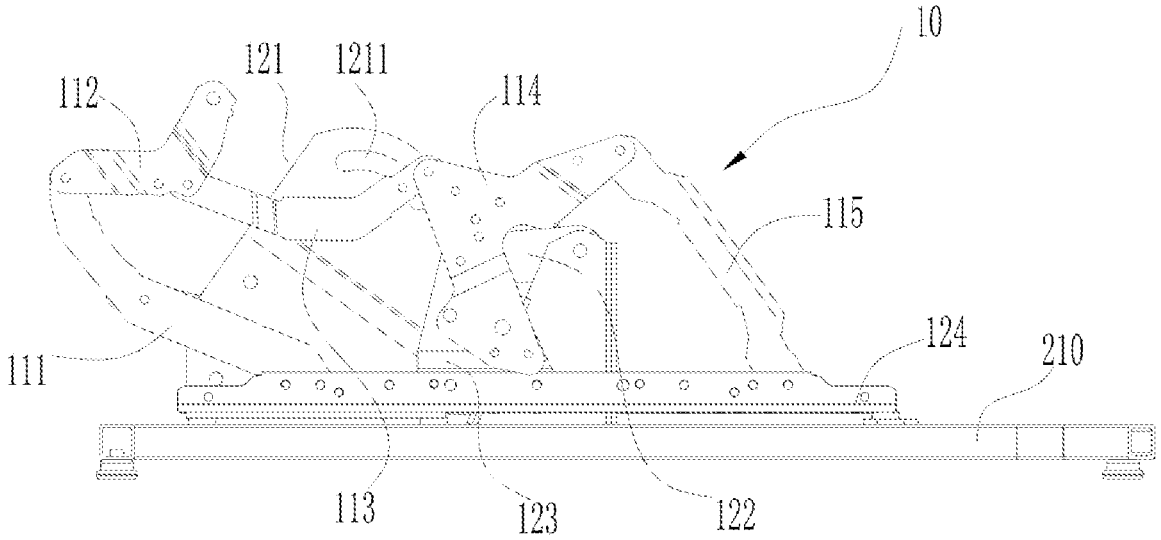
FIG. 7 is a structural schematic view of a movable component in a fully extending state in another embodiment of the present disclosure.
Figure 8:
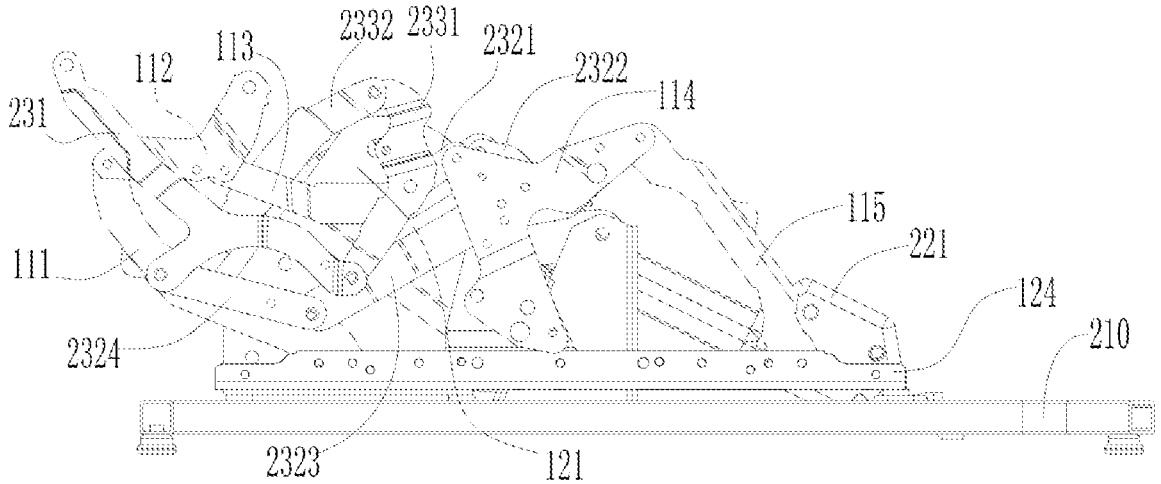
FIG. 8 is a structural schematic view of a transmission component in another embodiment of the present disclosure.
Figure 9:
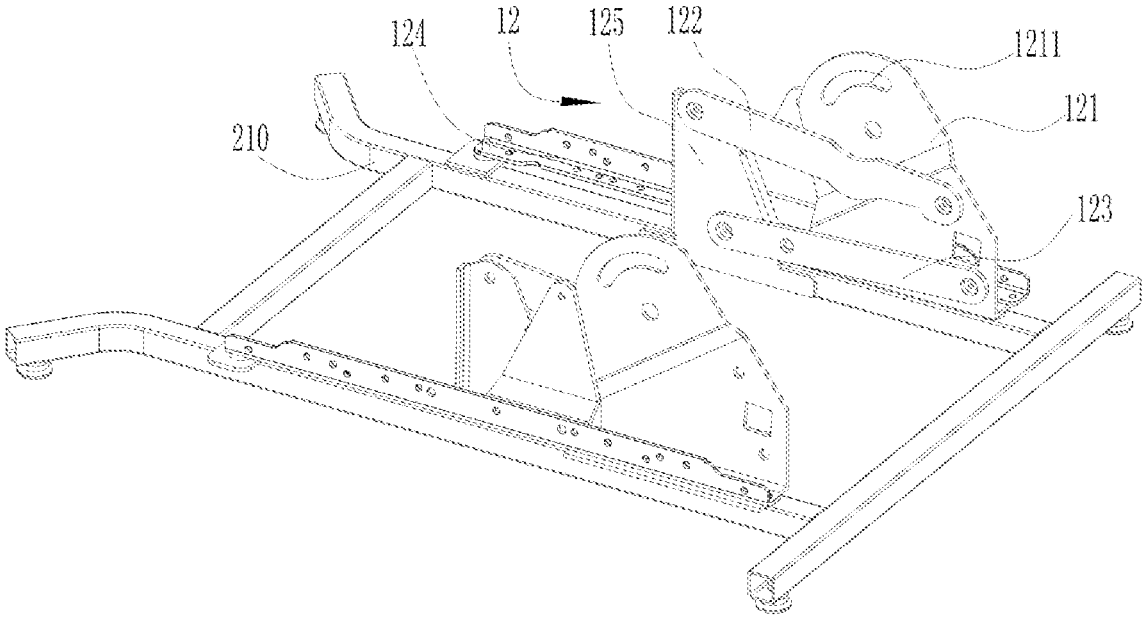
FIG. 9 is a structural schematic view of a lifting mechanism in another embodiment of the present disclosure.

FIG. 5 is a structural schematic view of a movable component 10 in a folding state in another embodiment of the present disclosure. FIG. 6 is a structural schematic view of a movable component 10 in a partially extending state in another embodiment of the present disclosure. FIG. 7 is a structural schematic view of a movable component 10 in a fully extending state in another embodiment of the present disclosure. FIG. 8 is a structural schematic view of a transmission component 230 in another embodiment of the present disclosure. FIG. 9 is a structural schematic view of a lifting mechanism 12 in another embodiment of the present disclosure.

Specifically, the movable component 10 includes an adjusting mechanism for sitting postures 11 and a lifting mechanism 12. The adjusting mechanism for sitting postures 11 is connected with the chair bracket 20 to adjust the sitting posture of the user on the chair bracket 20. The adjusting mechanism for sitting postures 11 includes a first movable connecting rod 111, a second movable connecting rod 112, a third movable connecting rod 113, a fourth movable connecting rod 114 and a fifth movable connecting rod 115. Two ends of the first movable connecting rod 111 are pivotally connected with the lifting mechanism 12 and the second movable connecting rod 112, respectively. Two ends of the fifth movable connecting rod 115 are pivotally connected with the same element of the lifting mechanism connected with the first movable connecting rod 111 and the fourth movable connecting rod 114, respectively. Two ends of the third movable connecting rod 113 are pivotally connected with the second movable connecting rod 112 and the fourth movable connecting rod 114, respectively. A state of the adjusting mechanism for sitting postures 11 can be switched between a folding state and an extending state relative to the lifting mechanism 12 when driven by the driving component 220. Specifically, when the user uses the chair 200 and adjusts the chair frame mechanism 100 to a lying position, the adjusting mechanism for sitting postures 11 can change from the folding state to the extending state, and both the first movable connecting rod 111 and the fifth movable connecting rod 115 can tilt and swing to a side close to the user's leg of the chair bracket 20. At the same time, the second movable connecting rod 112, the third movable connecting rod 113 and the fourth movable connecting rod 114 can move and extend along a direction far from the lifting mechanism 12. When the user leaves the chair 200, the adjusting mechanism for sitting postures 11 can change from the extending state to the folding state, and both the first movable connecting rod 111 and the fifth movable connecting rod 115 can tilt and swing to a side away from the user's leg of the chair bracket 20. At the same time, the second movable connecting rod 112, the third movable connecting rod 113 and the fourth movable connecting rod 114 can move and fold along a direction close to the lifting mechanism 12. In addition, the chair bracket 20 is pivotally connected with the second movable connecting rod 112 and the fourth movable connecting rod 114, so the chair bracket 20, the second movable connecting rod 112, the third movable connecting rod 113 and the fourth movable connecting rod 114 can form a four-connecting rod mechanism, and the four-connecting rod mechanism is defined as a second four-bar mechanism in the chair frame mechanism 100.

In the second four-bar mechanism, the chair bracket 20 is tilted. In the vertical direction, a pivot point between the chair bracket 20 and the second movable connecting rod 112 is higher than that between the chair bracket 20 and the fourth movable connecting rod 114.

The lifting mechanism 12 includes a first base plate 125, a first lifting connecting rod 122, a second lifting connecting rod 123 and a bottom connecting rod 124. The first base plate 125 is fixedly connected with the base 210, and the bottom connecting rod 124 is pivotally connected with the first movable connecting rod 111 and the fifth movable connecting rod 115 of the adjusting mechanism for sitting postures 11, respectively. The first base plate 125 is pivotally connected with the first lifting connecting rod 122 and the second lifting connecting rod 123, respectively. An end away from the first base plate 125 of the first lifting connecting rod 122 is pivotally connected with the second base plate 121 fixed on the bottom connecting rod 124. The bottom connecting rod 124, the first lifting connecting rod 122, the second lifting connecting rod 123 and the first base plate 125 can form a four-connecting rod mechanism, which is defined as a third four-bar mechanism in the chair frame mechanism 100.

The lifting mechanism 12 has a first state of fixation relative to the base 210 of the chair 200 and a second state of overall lifting relative to the base 210 of the chair 200. In the first state, the bottom connecting rod 124 can abut against the base 210, the first lifting connecting rod 122 and the second lifting connecting rod 123 are substantially disposed horizontally, the third four-bar mechanism is folded, and both the chair bracket 20 and the movable component 10 can move relative to the lifting mechanism 12. In the second state, the chair bracket 20 is relatively fixed with the adjusting mechanism for sitting postures 11, the third four-bar mechanism is extended and deformed, and the lifting mechanism 12 can lift the adjusting mechanism for sitting postures 11 and the seat bracket 20, together with the back component 40 and the leg component 30, resulting in that the user can leave the chair 200 easily.

The chair bracket 20 is substantially L-shaped, which is configured to support the weight of the user and provide support for the waist and the buttock of the user. The chair bracket 20 can move with the movement of the adjusting mechanism for sitting postures 11 relative to the lifting mechanism 12. When the lifting mechanism 12 is in the first state, the adjusting mechanism for sitting postures 11 can drive the chair bracket 20 to move along a direction close to the leg of the user when driven by the driving component 220, i.e., after the user sits on the chair 200, the adjusting mechanism for sitting postures 11 can move towards the front of the user. This moving direction is defined as the front of the chair 200 or the chair frame mechanism 100. The chair bracket 20 can move towards the front of the chair 200 for the user to lie down. When the user leaves the chair 200, the chair bracket 20 will move towards the rear of the chair 200 when driven by the adjusting mechanism for sitting postures 11 to achieve a reset of the chair bracket 20.

The leg component 30 is pivotally connected with a side close to the front of the chair 200 of the chair bracket 20. The leg component 30 includes at least one connecting rod that can rotate relative to the chair bracket 20 or at least one connecting rod mechanism pivotally connected with the chair bracket 20, for example, a four-connecting rod mechanism. When the leg component 30 rotates and extends along a direction away from the chair bracket 20, the leg component 30 can provide support for the leg of the user. When the user leaves the chair 200 after resting, the leg component 30 rotates and folds along a direction close to the chair bracket 20. Since the leg component 30 is not the technical content of protection required by the present disclosure, the leg component 30 will not be described in detail.

The back component 40 is disposed on a side close to the rear of the chair frame mechanism 100 of the chair bracket 20, and configured to provide support for the back of the user. The back component 40 includes a first back element 41, a second back element 42 and a back elastic member 43. The first back element 41 is pivotally connected with the chair bracket 20 and the second back element 42, respectively. An end away from the first back element 41 of the second back element 42 is pivotally connected with the fourth movable connecting rod 114. Two ends of the back elastic member 43 are connected with the chair bracket 20 and the fourth movable connecting rod 114, respectively. The chair bracket 20, the first back element 41, the second back element 42 and the fourth movable connecting rod 114 can form a four-connecting rod mechanism, which is defined as a first four-rod mechanism in the chair frame mechanism 100.

When the lifting mechanism 12 is in the first state, the driving component can drive the adjusting mechanism for sitting postures 11 to move, resulting in the chair bracket 20 moving towards the front of the chair 200. Due to the further extending of the adjusting mechanism for sitting postures 11, the chair bracket 20 will lift relative to the bottom connecting rod 124 in the process of moving towards the front of the chair 200, while the fourth movable connecting rod 114 does not lift significantly relative to the bottom connecting rod 124. Under a joint action of the fourth movable connecting rod 114 and the chair bracket 20, a first end pivotally connected with the chair bracket 20 of the first back element 41 is lifted, while a second end pivotally connected with the second back element 42 of the first back element 41 is pressed down relatively, resulting in that the first back element 41 has a motion effect of tilting to the rear of the chair 200 relative to the chair bracket 20. At this moment, the back component 40 extends relative to the chair bracket 20, and a backrest angle of the back component 40 of the chair 200 (i.e., an angle between the backrest of the chair 200 and the chair bracket 20) increases. After the user leaves the chair 200, the adjusting mechanism for sitting postures 11 can fold to reset, the chair bracket 20 can gradually fall from the lifting state relative to the bottom connecting rod 124, and the first end pivotally connected with the chair bracket 20 of the first back element 41 is pressed down, resulting in that the first back element 41 has a motion effect of tilting to the front of the chair 200 relative to the chair bracket 20. At this moment, the back component 40 is folded relative to the chair bracket 20, and the angle between the backrest of the chair 200 and the chair bracket 20 decreases.

In addition, the chair 200 with the chair frame mechanism 100 provided by the present disclosure further includes a transmission component 230. The transmission component 230 is configured to output the power of the driving component 220 to the leg component 30 and the movable component 10, and then drive the chair bracket 20 and the back component 40 to move indirectly.

Specifically, the bottom connecting rod 124 is provided with a second base plate 121 fixed to the bottom connecting rod 124. The transmission component 230 includes a first mechanism of transmission connecting rod, a second mechanism of transmission connecting rod and a power output member 231. The first mechanism of transmission connecting rod includes a first transmission connecting rod 2321, a second transmission connecting rod 2322, a third transmission connecting rod 2323 and a fourth transmission connecting rod 2324. The first transmission connecting rod 2321 is pivotally connected with the second base plate 121, and connected with the driving component. Two ends of the second transmission connecting rod 2322 are pivotally connected with the first transmission connecting rod 2321 and the third transmission connecting rod 2323, respectively. Two ends of the fourth transmission connecting rod 2324 are pivotally connected with the third transmission connecting rod 2323 and the power output member 231, respectively. The second mechanism of transmission connecting rod includes a fifth transmission connecting rod 2331 and a sixth transmission connecting rod 2332. Two ends of the fifth transmission connecting rod 2331 are pivotally connected with the power output member 231 and the sixth transmission connecting rod 2332, respectively. An end away from the fifth transmission connecting rod 2331 of the sixth transmission connecting rod 2332 is pivotally connected with the first movable connecting rod 111.

In some embodiments of the present disclosure, the driving component 220 includes a driving element 221 and a first driving beam. The driving element 221 can be a screw motor, which includes a push rod 2211 and a motor shell 2212. The motor shell 2212 is pivotally connected with the base 210 by a U-shaped seat 2221 fixed on the base 210 of the chair 200. The push rod 2211 can move relative to the motor shell 2212. An end away from the motor shell 2212 of the push rod 2211 is pivotally connected with the first driving beam 222 by the U-shaped seat 2221 fixed on the first driving beam 222, and an end of the first driving beam 222 is provided with a fan-shaped plate 2222 fixed to the first driving beam 222. It can be understood that the driving element 221 also can be a power output device other than a screw motor.

The second base plate 121 is provided with a sliding groove 1211. The sliding groove 1211 can be in an arc shape having a center, which is a pivot point between the second base plate 121 and the first transmission connecting rod 2321. A first pivot 2223 and a second pivot 2224 are fixedly disposed on the first transmission connecting rod 2321. The first pivot 2223 can movably penetrate through the sliding groove 1211 and be fixedly connected with the fan-shaped plate 2222. The second pivot 2224 can penetrate through the second base plate 121. It can realize a pivotal connection between the first transmission connecting rod 2321 and the second base plate 121. When the screw motor is in operation, the push rod 2211 can be controlled to telescopically move relative to the motor shell 2212, resulting in driving the first transmission connecting rod 2321 by the first driving beam 222 to rotate relative to the second base plate 121 and along an axis of the second pivot 2224, and the second base plate 121 is sheathed on the first pivot 2223 by the sliding groove 1211, limiting a rotation angle of the first transmission connecting rod 2321.

The conventional chair frame usually adjusts a position or a state of the leg component or the back component, and the sitting posture of the chair bracket by a single power source. For example, a conventional elderly chair is provided on the market which can drive the leg component and the back component to extend or fold relative to the chair bracket by a single motor, and drive the chair bracket to adjust the sitting posture and using state. A number of elements in the chair frame body of the elderly chair is much more, and a structure for power transmission is complex, resulting in that the chair bracket, the leg component and the back component often move at the same time and switch positions and states when the chair is in operation, leading to increase a discomfort of the user, and even produce motion interference between different functional components. The conventional chair is difficult to meet the actual requirements of the user, the use experience of the conventional chair is poor, and the conventional chair does not conform to the ergonomic design concept.

In view of the above, the chair frame mechanism 100 provided in the present disclosure further includes a sequence component 50 connected with the movable component 10 and the chair bracket 20, respectively. The sequence component 50 is connected with the leg component 30 and the back component 40 by transmission. The sequence component 50 can control the chair bracket 20 to move relative to the movable component 10 along the preset trajectory, so as to adjust the sitting posture of the chair bracket 20 better, and control the leg component 30 and the back component 40 to extend or fold relative to the chair bracket 20 in order. The position and the state of the leg component 30 and the back component 40 relative to the chair bracket 20 can be adjusted in an orderly manner according to a preset motion order, avoiding a simultaneous relative movement or a chaotic motion order of the leg component 30 and the back component 40.

It should be noted that the chair frame mechanism 100 provided in the present disclosure is not only applicable to an occasion where the chair 200 is provided with the driving component 220 and operated in a way of electric control driving, but also applicable to an occasion where the chair 200 is not provided with the driving component 220 and the user controls the operation of the chair 200 by manual driving. The user can exert force to the adjusting mechanism for sitting postures 11, the leg component 30, the back component 40 and the chair bracket 20 indirectly by other transmission devices, and the user itself is a single power source.

Figure 10:
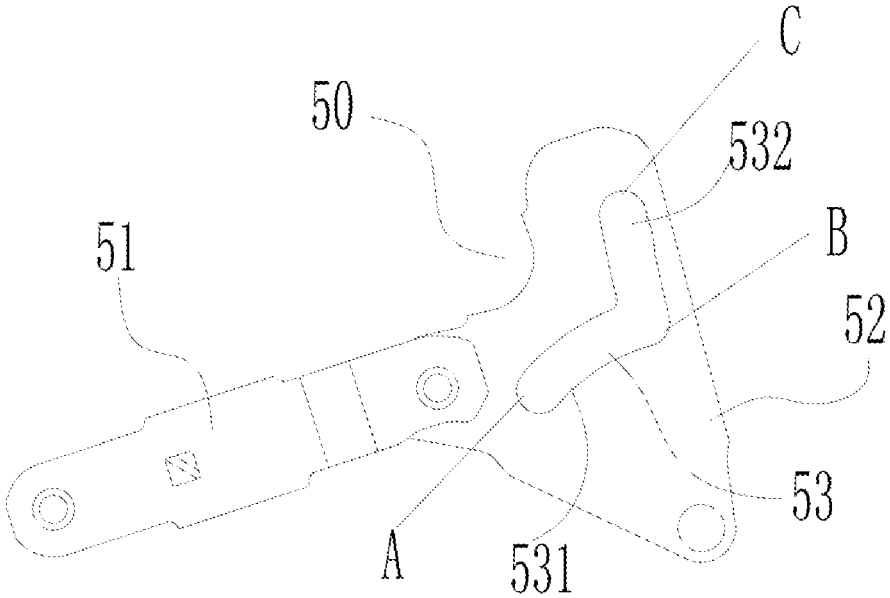
FIG. 10 is a structural schematic view of a sequence component in another embodiment of the present disclosure.

Referring to FIG. 10, FIG. 10 is a structural schematic view of a sequence component 50 in another embodiment of the present disclosure. In some embodiments of the present disclosure, the sequence component 50 includes a swing controlling element 52 and a sequence connecting rod 51. The swing controlling element 52 is a fan-shaped or nearly fan-shaped plate and pivotally connected with the fourth movable connecting rod 114 in the adjusting mechanism for sitting postures 11, so as to realize a transmission connection with the back component 40 by the fourth movable connecting rod 114. A first end of the sequence connecting rod 51 is pivotally connected with the swing controlling element 52, a second end of the sequence connecting rod 51 is pivotally connected with the power output member 231, and further connected with the leg component 30 by transmission via the power output member 231, resulting in associating motion between the sequence connecting rod 51 and the leg component 30.

A sliding connection structure is formed between the swing controlling element 52 and the chair bracket 20. Specifically, the chair bracket 20 is fixedly provided with a guide block 54, and the swing controlling element 52 is provided with a guide groove 53 defined as the preset trajectory. The guide block 54 penetrates through the guide groove 53 and can slide in the guide groove 53, so the swing controlling element 52 can move relative to the fourth movable connecting rod 114 when driven by the sequence connecting rod 51. Through a sliding cooperation between the guide groove 53 and the guide block 54, the chair bracket 20 is controlled to move relative to the fourth movable connecting rod 114 along the preset trajectory defined by guide groove 53.

The preset trajectory refers to that, under the control of the swing controlling element 52 by the sliding cooperation between the guide groove 53 and the guide block 54, a motion trajectory of the chair bracket 20 at the position of the guide block 54 relative to the fourth movable connecting rod 114, i.e., relative to the adjustment mechanism for sitting postures 11, corresponds to an extended trajectory of the guide groove 53. Therefore, the sequence component 50 can determine an overall motion trajectory of the chair bracket 20 relative to the adjustment mechanism for sitting postures 11.

It can be understood that, in other embodiments, the guide groove 53 can be disposed on the chair bracket 20 and the guide block 54 can be fixed on the swing controlling element 52, which can also realize the movement effect and technical scheme in the above embodiments, and also fall into the protection scope required by the present disclosure.

The chair bracket 20 can move relative to the adjustment mechanism for sitting postures 11, and the chair bracket 20 can move relative to the bottom connecting rod 124 of the lifting mechanism 12 when driven by the adjustment mechanism for sitting postures 11, so as to realize the sitting posture adjustment of the chair bracket 20.

Furthermore, the guide groove 53 includes a first guide portion 531 and a second guide portion 532 that are communicated with each other. The guide block 54 can continuously slide from the first guide portion 531 to the second guide portion 532 or from the second guide portion 532 to the first guide portion 531 while the chair bracket 20 moves relative to the adjustment mechanism for sitting postures 11. Specifically, when the chair frame mechanism 100 is operated by the action of a single power source, a sliding process of the guide block 54 in the first guide portion 531 corresponds to the leg component 30 extending or folding relative to the chair bracket 20, while the back component 40 is fixed relative to the chair support 20; a sliding process of the guide block 54 in the second guide portion 532 corresponds to the back component 40 extending or folding relative to the chair bracket 20, while the leg component 30 is fixed relative to the chair bracket 20. A sliding process of the guide block 54 from the first guide portion 531 to the second guide portion 532 corresponds to an overall extending process of the chair frame mechanism 100, i.e., both the leg component 30 and the back component 40 extend relative to the chair bracket 20, while the adjustment mechanism for sitting postures 11 extends. A sliding process of the guide block 54 from the second guide portion 532 to the first guide portion 531 corresponds to an overall folding process of the chair frame mechanism 100, i.e., both the leg component 30 and the back component 40 fold relative to the chair bracket 20, while the adjustment mechanism for sitting postures 11 folds.

In some embodiments of the present disclosure, the first guide portion 531 can be in a circular arc shape, a center of which is also a pivot point between the swing controlling element 52 and the fourth movable connecting rod 114. The second guide portion 532 can be in a straight line shape, and the second guide portion 532 and a pivot point between the swing controlling element 52 and the fourth movable connecting rod 114 are collinear.

Referring to FIG. 10 again, the first guide portion 531 corresponds to a part of the guide groove 53 between point A and point B, and the second guide portion 532 corresponds to a part of the guide groove 53 between point B and point C. A process of the guide block 54 moving from point A to point B as shown in FIG. 10 corresponds to the following movement process: the driving component 220 starts to operate, and the power output member 231 moves towards the front of the chair 200 and generates thrust on the leg component 30 to push the leg component 30 to extend. Meanwhile, the power output member 231 drives the adjustment mechanism for sitting postures 11 to expand as a whole by the second mechanism of transmission connecting rod, and both the first movable connecting rod 111 and the fifth movable connecting rod 115 rotate and tilt towards the front of the chair 200. The chair bracket 20 moves towards the front of chair 200 as a whole along with the second four-bar mechanism, and the chair bracket 20 is fixed relative to the fourth movable connecting rod 114, resulting in that the first four-bar mechanism is fixed. In summary, the movement of the guide block 54 from point A to point B corresponds to a change process of the leg component 30 from folding to extending relative to the chair bracket 20, while the back component 40 is fixed relative to the chair bracket 20.

In the above moving process, the push rod 2211 of a driving motor is contracted, driving the first mechanism of transmission connecting rod as a whole to tilt towards the rear of the chair 200 by the first driving beam 222. The first transmission connecting rod 2321 can rotate relative to the second base plate 121 along a direction away from the leg of the user, i.e., a clockwise rotation as shown in FIG. 4, and drive the third transmission connecting rod 2323 to produce a clockwise rotation trend by the second transmission connecting rod 2322. The third transmission connecting rod 2323 can drive the power output member 231 to push the leg component 30 to extend by the fourth transmission connecting rod 2324. At the same time, the power output member 231 can drive the sixth transmission connecting rod 2332 to move by the fifth transmission connecting rod 2332, so as to drive the first movable connecting rod 111 to rotate relative to the bottom connecting rod 124. As shown in FIG. 5 to FIG. 7, the first transmission connecting rod 2321 can rotate counterclockwise relative to the bottom connecting rod 124. The second movable connecting rod 112 is relatively stationary, the chair bracket 20 is fixed relative to the fourth movable connecting rod 114, and the chair bracket 20 and the fourth movable connecting rod 114 can rotate together relative to the fifth movable connecting rod 115.

As the swing controlling element 52 can rotate relative to the fourth movable connecting rod 114, the first guide portion 531 which is in a circular arc shape can avoid a movement of the chair bracket 20 relative to the fourth movable connecting rod 114 when the guide block 54 slides in the first guide portion 531, avoiding a movement of the second four-bar mechanism, so as to avoid a movement of the back component 40 relative to the chair bracket 20 caused by a movement of the first four-bar mechanism.

A process of the guide block 54 moving from point B to point C as shown in FIG. 10 corresponds to the following movement process: the driving component 220 keeps operating, and the leg component 30 reaches a ultimate position of extending relative to the chair bracket 20 and then is fixed relative to the chair bracket 20. The power output member 231 continues to drive the adjustment mechanism for sitting postures 11 to extend by the second mechanism of transmission connecting rod. The first movable connecting rod 111 and the fifth movable connecting rod 115 continue to rotate towards the front of the chair 200, and the second four-bar mechanism starts to move, i.e., the chair bracket 20 starts to move relative to the fourth movable connecting rod 114, and the chair bracket 20 can lift relative to the bottom connecting rod 124 of the lifting mechanism 12 to drive the first four-bar mechanism to move. The first back element 41 is hinged to one end of the seat support 20 with respect to the bottom link 124. A first end pivotally connected with the chair bracket 20 of the first back element 41 is lifted relative to the bottom connecting rod 124, a second end pivotally connected with the second back element 42 of the first back element 41 is pressed down relative to the bottom connecting rod 124, and the first back element 41 extends relative to the chair bracket 20. An angle between the first back element 41 and the chair bracket 20, i.e. the backrest angle of the chair 200, is increased for the user to lie down. In summary, the movement of the guide block 54 from point B to point C corresponds to a change process of the back component 40 from folding to extending relative to the chair bracket 20, while the leg component 30 is fixed relative to the chair bracket 20.

In the above moving process, the push rod 2211 of the driving motor is further contracted, continuing to drive the first mechanism of transmission connecting rod as a whole to tilt towards the rear of the chair 200 by the first driving beam 222, and continuing to drive the second mechanism of transmission connecting rod to move by the power output member 231. The first movable connecting rod 111 is further driven to rotate relative to the bottom connecting rod 124, resulting in further extending the adjusting mechanism for sitting postures 11, extending the second movable connecting rod 112, the chair bracket 20 and the fourth movable connecting rod 114. At this moment, the pivot point between the chair bracket 20 and the fourth movable connecting rod 114 is lifted relative to the bottom connecting rod 124, and the pivot point between the chair bracket 20 and the second movable connecting rod 112 is pressed down relative to the bottom connecting rod 124. Therefore, an overall posture of the chair bracket 20 is gentler, which is convenient for the user to lie down. At the same time, the chair bracket 20 drives the first back component 41 to turn over, resulting in increasing the backrest angle of the chair 200.

The extending of the second movable connecting rod 112, the chair bracket 20 and the fourth movable connecting rod 114 can be a change process of the pivot points among the second movable connecting rod 112, the chair bracket 20 and the fourth movable connecting rod 114 tending to be collinear under the action of external force. When the pivot points among the second movable connecting rod 112, the chair bracket 20 and the fourth movable connecting rod 114 seat bracket 20 is collinear or tends to be collinear, the second movable connecting rod 112, the chair bracket 20 and the fourth movable connecting rod 114 reach a extending state and cannot be further extended.

A turning point is disposed between the first guide portion 531 and the second guide portion 532. When the guide block 54 is sliding to point B, an inner wall of the guide groove 53 abuts against the guide block 54 to restrict a further rotation of the swing controlling element 52 relative to the chair bracket 20. The adjusting mechanism for sitting postures 11 can move and force the chair bracket 20 to move along a trajectory of the second guide portion 532 relative to the fourth movable connecting rod 114, and the chair bracket 20 can generate a translational movement effect relative to the swing controlling element 52. A rotation of the sequence connecting rod 51 relative to the swing controlling element 52 just can counteract the movement effect of the power output member 231 when further driven by the driving component 220. The leg component 30 is fixed relative to the chair bracket 20 under a joint action of the swing controlling element 52, the sequence connecting rod 51 and the chair bracket 20.

The second guide portion 532 which is in a straight line shape has the following effect: a rotation of the swing controlling element 52 relative to the chair bracket 20 is limited when the back component 40 moves relative to the chair bracket 20, thus allowing the leg component 30 to maintain to be fixed to the chair bracket 20. Finally, the leg component 30 is fixed relative to the chair bracket 20 when the back component 40 moves relative to the chair bracket 20, i.e., a folding movement of the back component 40 relative to the chair bracket 20 occurs before a folding movement of the leg component 30 relative to the chair bracket 20.

When the user leaves the chair 200 after resting, the screw motor can control the push rod 2211 to extend out of the screw motor, and the push rod 2211 can drive the first driving beam 222 to move towards the front of the chair 200 along a trajectory of the sliding groove 1211, and drive the first transmission connecting rod 2321 to rotate to the front of the chair 200 relative to the second base plate 121. As shown in FIG. 8, the whole of the first mechanism of transmission connecting rod can rotate in a counterclockwise direction relative to the lifting mechanism 12. Driven by the first mechanism of transmission connecting rod, the power output member 231 can control the leg component 30 to move closer to the chair bracket 20 and to fold, while driving the second mechanism of transmission connecting rod to move. The adjusting mechanism for sitting postures 11 can fold relative to the lifting mechanism 12 when driven by the second mechanism of transmission connecting rod, while the first movable connecting rod 111 and the fifth movable connecting rod 115 can rotate clockwise relative to the bottom connecting rod 124 as shown from FIG. 7 to FIG. 5, thus driving the chair bracket 20 to move towards the rear of the chair 200 to reset.

After the back of the user leaves the first back element 41, the first back element 41 can rotate counterclockwise relative to the chair bracket 20 as shown from FIG. 3 to FIG. 2, thus realizing a refolding of the back component 40, and the backrest angle between the first back component 41 and the chair bracket 20 decreases again.

Furthermore, in the chair 200 provided in the present disclosure, a number of the chair frame mechanism 100 is two sets, and the two sets of the chair frame mechanism 100 are symmetrically disposed relative to the base 210 and can move in association with each other. The two sets of the chair frame mechanism 100 have better support effect, and it is more convenient to arrange the covering or other structural parts for support on the outside of the chair frame mechanism 100.

Specifically, in the embodiment, two sets of the first movable connecting rod 111 are connected by a first linkage element between the two sets of the chair frame mechanism 100, and two sets of the second movable connecting rod 112 are connected by the second linkage element, so as to associate motion of the two sets of the chair frame mechanism 100.

Furthermore, in some embodiments, the chair frame mechanism 100 is further provided with a locking mechanism, which includes a locking connecting rod 61, a locking arm 62, a locking elastic member 63 and a locking limiting member 64. The locking connecting rod 61 is pivotally connected with the chair bracket 20 and a first end of the locking arm 62, respectively. A second end of the locking arm 62 is pivotally connected with the leg component 30. Two ends of the locking elastic member 63 are connected with the locking arm 62 and the chair bracket 20, respectively. The locking limiting member 64 is disposed on the chair bracket 20 or the locking connecting rod 61 and configured to abut against the locking arm 62. When the leg component 30 is folded and close to the chair bracket 20, the locking elastic member 63 and the locking limiting member 64 work together to maintain the locking arm 62 to be fixed relative to the chair bracket 20, resulting in that the locking mechanism is fixed relative to the chair bracket 20 and the leg component 30 maintains to be fixed relative to the chair bracket 20 under the action of the locking mechanism.

Figure 11:
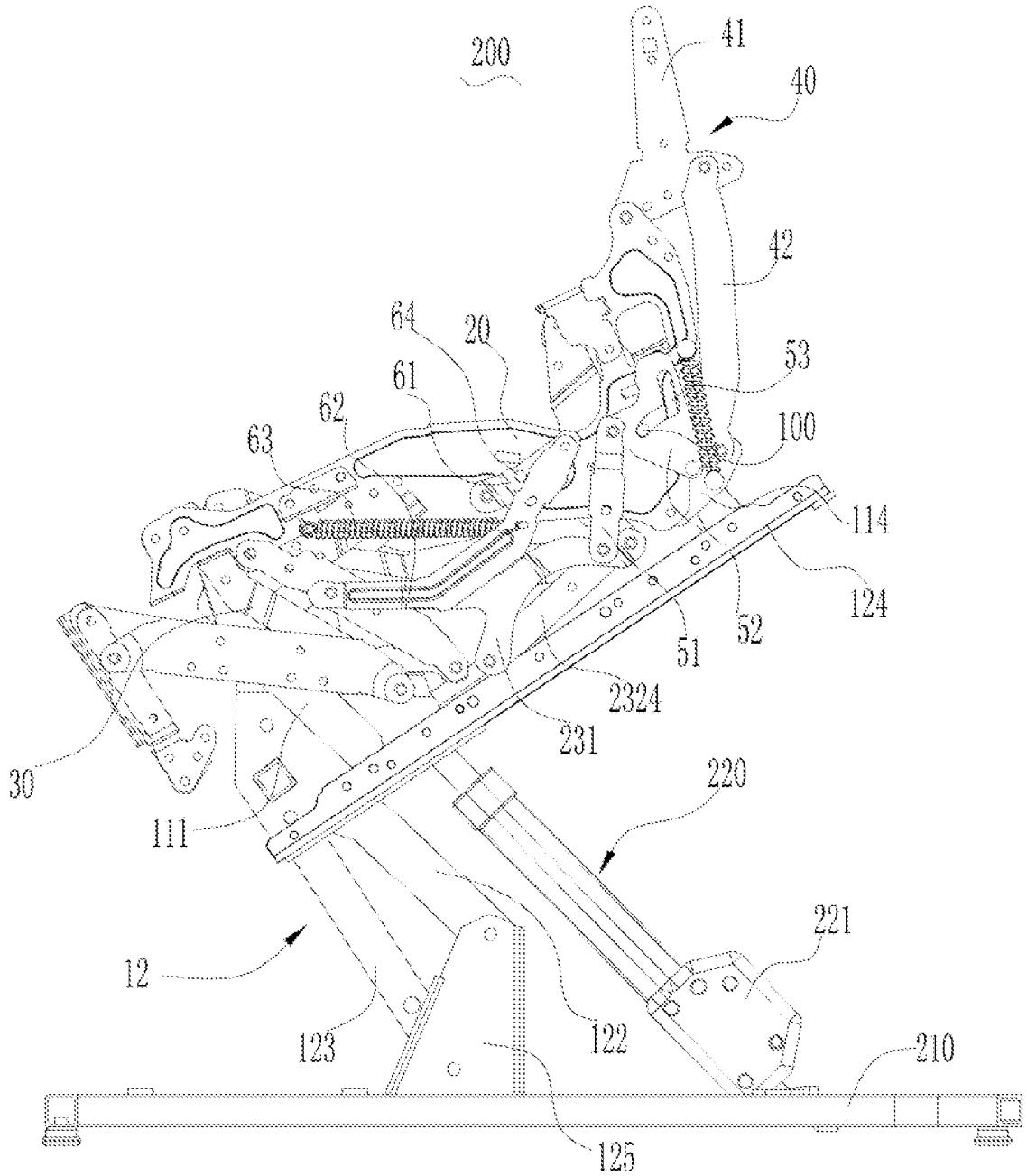
FIG. 11 is a side view of a chair in a lifting state in another embodiment of the present disclosure.
Figure 12:
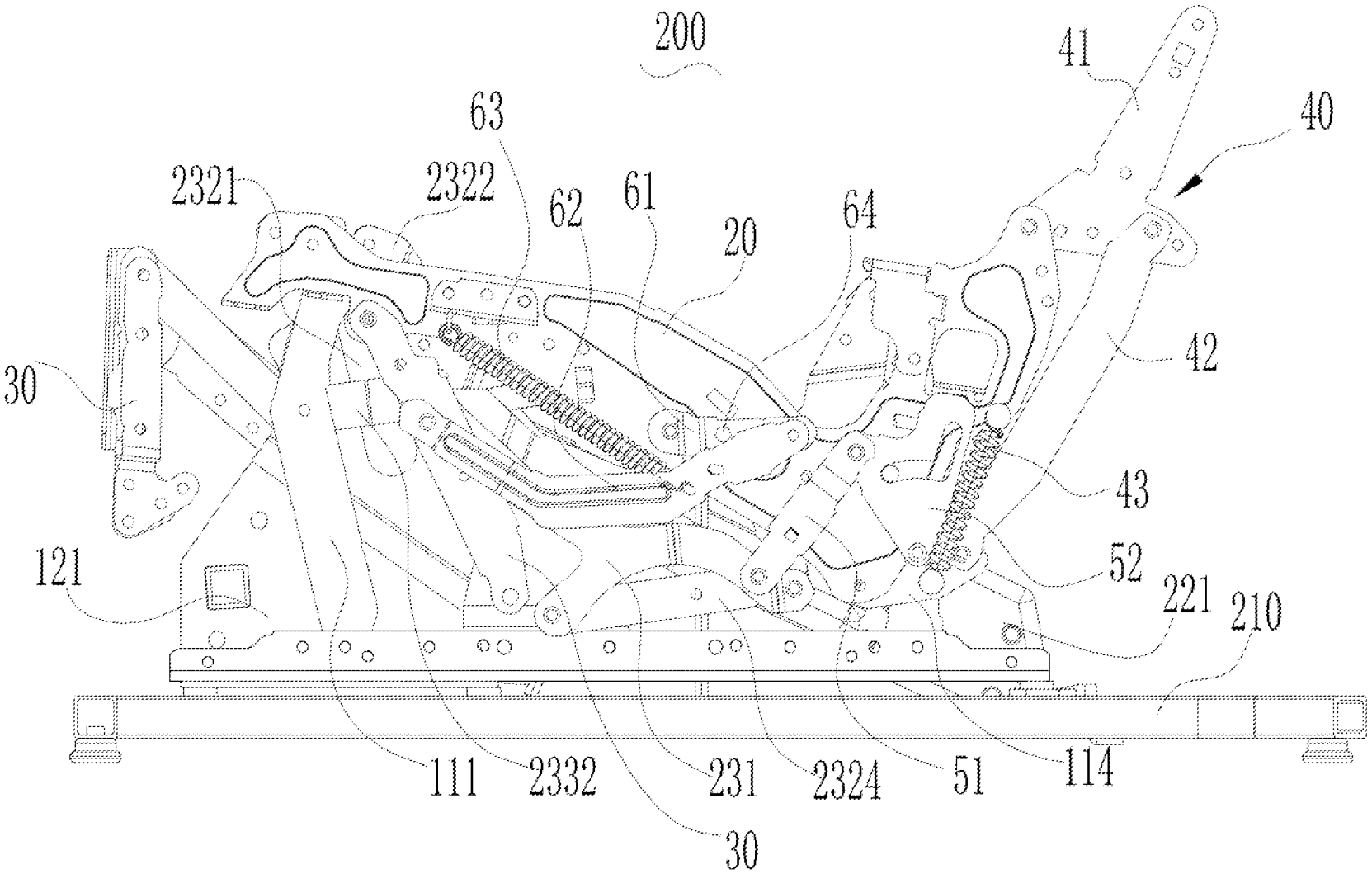
FIG. 12 is a side view of a chair in a folding state in another embodiment of the present disclosure.
Figure 13:
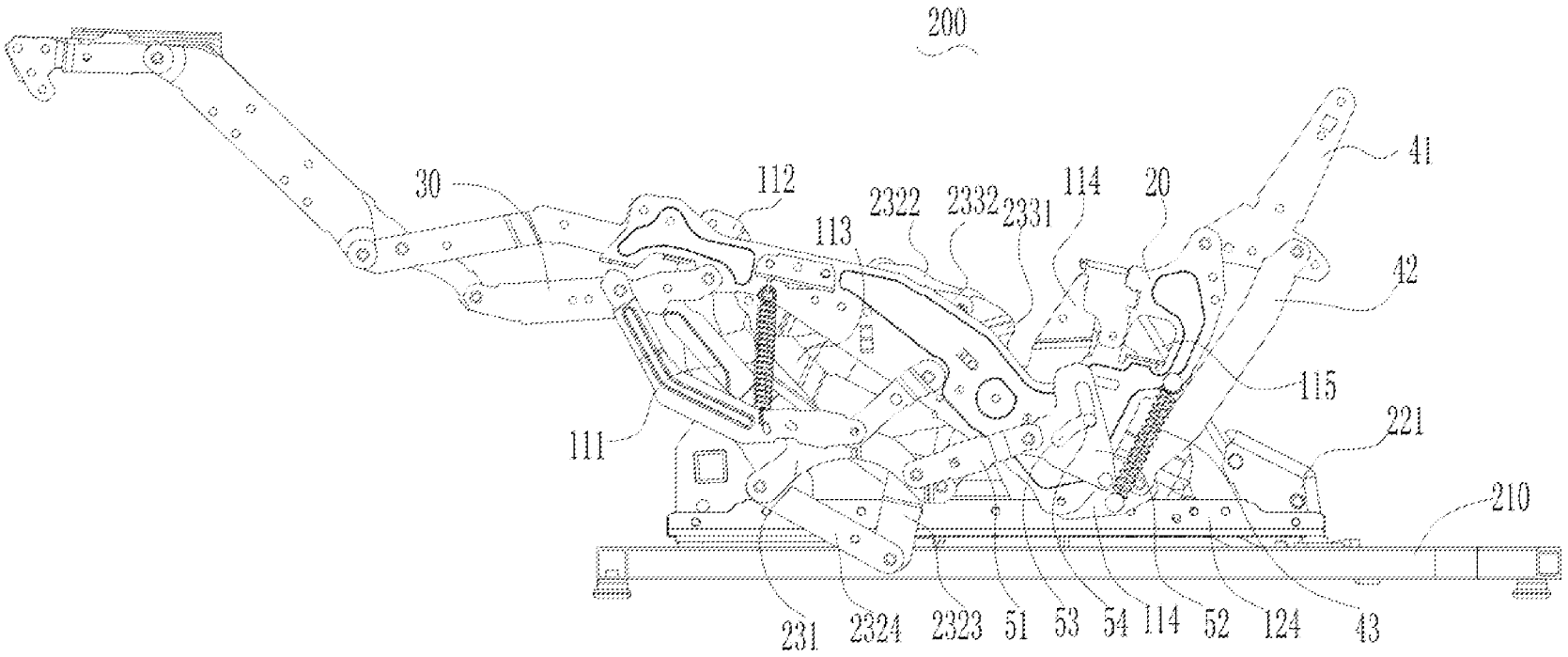
FIG. 13 is a side view of a chair in a partially extending state in another embodiment of the present disclosure.
Figure 14:
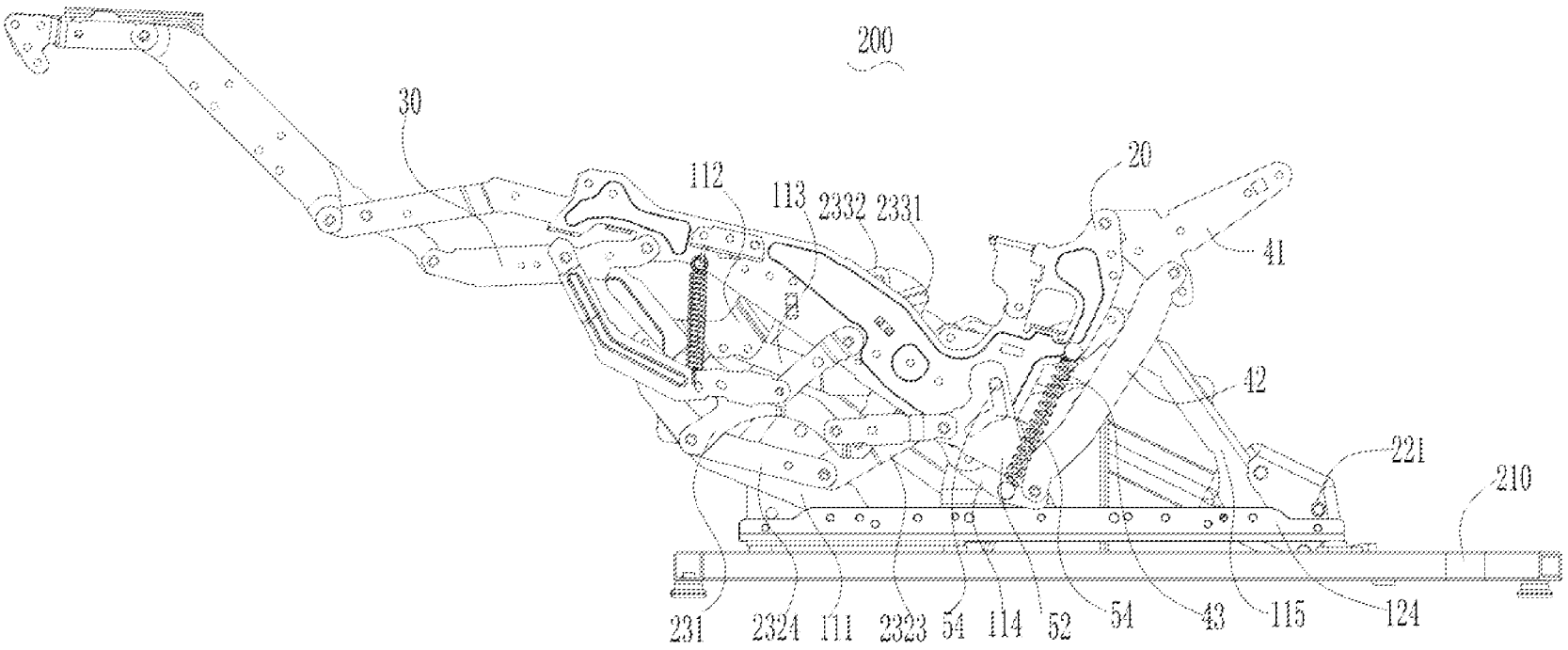
FIG. 14 is a side view of a chair in a fully extending state in another embodiment of the present disclosure.

The operation process of the chair 200 provided in the present disclosure is as following. FIG. 11 is a side view of a chair 200 in a lifting state in another embodiment of the present disclosure. FIG. 12 is a side view of a chair 200 in a folding state in another embodiment of the present disclosure. FIG. 13 is a side view of a chair 200 in a partially extending state in another embodiment of the present disclosure. FIG. 14 is a side view of a chair 200 in a fully extending state in another embodiment of the present disclosure.

FIG. 11 shows a structural schematic view of the chair 200 when the chair 200 is not in use. At this moment, the push rod 2211 of the screw motor reaches a maximum elongation, both the leg component 30 and the back component 40 are fixed relative to the chair bracket 20, and the adjusting mechanism for sitting postures 11 also reaches a tightening state. The thrust of the screw motor causes the third four-bar mechanism to be deformed. Both the first lifting connecting rod 122 and the second lifting connecting rod 123 can rotate relative to the first base plate 125, pushing the bottom connecting rod 124 to lift relative to the base 210, and driving the adjusting mechanism for sitting postures 11 to lift together with the chair bracket 20, the leg component 30 and the back component 40 as a whole. In this state, the user can leave the chair 200.

FIG. 12 shows a structural schematic view of the chair 200 in a sitting posture. At this moment, the push rod 2211 of the screw motor contracts, and the third four-bar mechanism further deforms to drive the bottom connecting rod 124 to fall back and contact with the base 210. Meanwhile, both the leg component 30 and the back component 40 are fixed relative to the chair bracket 20, while the leg component 30 and the back component 40 are still folded relative to the chair bracket 20. In this state, the user can use the chair in a normal sitting posture.

FIG. 13 shows a structural schematic view of the chair 200 in a process of changing from a sitting posture to a lying posture. The screw motor can further contract and drive the adjusting mechanism for sitting postures 11 to extend by the transmission component 230. Both an end away from the bottom connecting rod 124 of the first movable connecting rod 111 and an end away from the bottom connecting rod 124 of the fifth movable connecting rod 115 can move towards the front of the chair 200. The chair bracket 20 can move some distance towards the front of the chair 200. Meanwhile, the leg component 30 can extend relative to the chair bracket 20, and the back component 40 can maintain to be fixed relative to the chair bracket 20. During this process, the guide block 54 can slide in the first guide portion 531 along a direction close to the second guide portion 532.

FIG. 14 shows a structural schematic view of the chair 200 in a lying posture. At this moment, the push rod 2211 of the screw motor contracts to the shortest state, and the leg component 30 has reached a preset extending position and is fixed relative to the chair bracket 20. The adjusting mechanism for sitting postures 11 is further extended. An end away from the bottom connecting rod 124 of the first movable connecting rod 111 and an end away from the bottom connecting rod 124 of the fifth movable connecting rod 115 can further move towards the front of the chair 200, and the chair bracket 20 can further move towards the front of the chair 200. The back component 40 is extended relative to the chair bracket 20, and the backrest angle of the chair 200 between the first back component 41 and the chair bracket 20 increases. In this state, the back and the leg of the user can be reliably supported, resulting in that the user can use the chair 200 in the lying posture.

In summary, FIG. 12 to FIG. 14 correspond to the extending process of the leg component 30 relative to the chair bracket 20 prior to the extending process of the back component 40 relative to the chair bracket 20, i.e., the support for the leg of the user is realized at first, and then the back angle of the user is adjusted. FIG. 14 to FIG. 12 correspond to the folding process of the back component 40 relative to the chair bracket 20 prior to the folding process of the leg component 30 relative to the chair bracket 20, i.e., when the user wants to end using the chair 200, the back component 40 should be reset firstly, and the leg component 30 should be folded after the user changes from the lying posture to the sitting posture, resulting in that the user can get up and leave quickly.

The present disclosure provides the chair frame mechanism 100. By disposing the sequence component 50, the chair frame mechanism 100 has the definite moving trajectory, and a position change and a state change of the leg component 30 and the back component 40 can be carried out in a preset sequence. Thus, the leg component 30 and the back component 40 are extended or folded step by step relative to the chair bracket 20, avoiding a disordered or simultaneous movement of the leg component 30 and the back component 40, resulting in preventing bad operation conditions such as collision interference in the chair frame mechanism 100. In addition, the leg component 30 and the back component 40 move respectively to achieve an adjustment for leg support and an adjustment for back support in order, resulting in preventing a tension of the user caused by a simultaneous adjustment of leg support and back support. The movement of the leg component 30 and the back component 40 conforms to the ergonomic design concept. Therefore, it not only meets the requirements of the user for adjusting the sitting postures, but also improves the use experience of the chair.

The technical features of the above-described embodiments may be combined in any combination. For the sake of brevity of description, all possible combinations of the technical features in the above embodiments are not described. However, as long as there is no contradiction between the combinations of these technical features, all should be considered as within the scope of this disclosure.

The above-described embodiments are merely illustrative of several embodiments of the present disclosure, and the description thereof is relatively specific and detailed, but is not to be construed as limiting the scope of the disclosure. It should be noted that a number of variations and modifications may be made by those skilled in the art without departing from the spirit and scope of the disclosure. Therefore, the scope of the disclosure should be determined by the appended claims.

I claim:

1. A chair frame mechanism, comprising a movable component, a chair bracket, a leg component, a back component and a sequence component, wherein the movable component is connected with the chair bracket, the leg component and the back component are pivotally connected with the chair bracket, respectively, and the back component is connected to the movable component, the sequence component is connected with the movable component and the chair bracket, respectively, and connected with the leg component and the back component by transmission, respectively, the sequence component is capable of controlling the chair bracket to move relative to the movable component along a preset trajectory, and orderly controlling the leg component and the back component to extend or fold relative to the chair bracket, the movable component comprises an adjusting mechanism for sitting postures and a lifting mechanism, and the adjusting mechanism for sitting postures is pivotally connected with the lifting mechanism and the chair bracket, respectively, the sequence component comprises a swing controlling element and a sequence connecting rod, the swing controlling element is pivotally connected with the adjusting mechanism for sitting postures, connected with the back component by transmission via the adjusting mechanism for sitting postures, and movably connected with the chair bracket, a first end of the sequence connecting rod is pivotally connected to the swing controlling element, and a second end of the sequence connecting rod is connected with the leg component by transmission, the adjusting mechanism for sitting postures is capable of moving and driving the chair bracket to move relative to the lifting mechanism, the sequence connecting rod is capable of moving in association with the leg component, and the swing controlling element is capable of moving relative to the adjusting mechanism for sitting postures when driven by the sequence connecting rod, resulting in controlling the chair bracket to move relative to the adjusting mechanism for sitting postures along the preset trajectory.

2. The chair frame mechanism of claim 1, wherein one of the swing controlling element and the chair bracket is provided with a guide groove, the other one of the swing controlling element and the chair bracket is provided with a guide block sliding with the guide groove, and the guide groove is defined as the preset trajectory for the sliding of the guide block.

3. The chair frame mechanism of claim 2, wherein the guide groove comprises a first guide portion and a second guide portion that are communicated with each other, and the guide block is capable of continuously sliding from one of the first guide portion and the second guide portion to the other one of the first guide portion and the second guide portion, in a process of the guide block sliding in the first guide portion, the swing controlling element is capable of controlling the leg component to extend or fold relative to the chair bracket, and controlling the back component to fix relative to the chair bracket, in a process of the guide block sliding in the second guide portion, the swing controlling element is capable of controlling the back component to extend or fold relative to the chair bracket, and controlling the leg component to fix relative to the chair bracket.

4. The chair frame mechanism of claim 3, wherein the first guide portion is in a circular arc shape having a center, which is a pivot point between the swing controlling element and the adjusting mechanism for sitting postures.

5. The chair frame mechanism of claim 3, wherein the second guide portion is in a straight line shape, and the straight line and a pivot point between the swing controlling element and the adjusting mechanism for sitting postures are collinear.

6. The chair frame mechanism of claim 1, wherein the back component comprises a first back element and a second back element, the first back element is pivotally connected with the chair bracket and the second back element, respectively, an end away from the first back element of the second back element is pivotally connected with the adjusting mechanism for sitting postures, and connected with the swing controlling element by transmission via the adjusting mechanism for sitting postures, and the chair bracket, the first back element, the second back element and the adjusting mechanism for sitting postures form a first four-rod mechanism.

7. The chair frame mechanism of claim 6, wherein the back component further comprises a back elastic member, and the back elastic member is connected with the chair bracket and the adjusting mechanism for sitting postures, respectively, and the back elastic member is capable of controlling an extending or folding process of the first back element relative to the chair bracket.

8. The chair frame mechanism of claim 1, wherein the adjusting mechanism for sitting postures comprises a first movable connecting rod, a second movable connecting rod, a third movable connecting rod, a fourth movable connecting rod and a fifth movable connecting rod, two ends of the first movable connecting rod are pivotally connected with the lifting mechanism and the second movable connecting rod, respectively, two ends of the fifth movable connecting rod are pivotally connected with the lifting mechanism and the fourth movable connecting rod, respectively, two ends of the third movable connecting rod are pivotally connected with the second movable connecting rod and the fourth movable connecting rod, respectively, and the fourth movable connecting rod is pivotally connected with the swing controlling element, the chair bracket is pivotally connected with the second movable connecting rod and the fourth movable connecting rod, respectively, and the chair bracket, the second movable connecting rod, the third movable connecting rod and the fourth movable connecting rod form a second four-bar mechanism.

9. The chair frame mechanism of claim 1, wherein the lifting mechanism comprises a first base plate, a first lifting connecting rod, a second lifting connecting rod and a bottom connecting rod, the bottom connecting rod is pivotally connected with the adjusting mechanism for sitting postures, and the first base plate is pivotally connected with the first lifting connecting rod and the second lifting connecting rod, respectively, an end away from the first base plate of the first lifting connecting rod is pivotally connected with the bottom connecting rod, and an end away from the first base plate of the second lifting connecting rod is pivotally connected with the bottom connecting rod, and the first base plate, the first lifting connecting rod, the second lifting connecting rod and the bottom connecting rod form a third four-bar mechanism.

10. A chair, comprising a base and the chair frame mechanism of claim 1, wherein the chair frame mechanism is connected with the base by the movable component.

11. The chair of claim 10, further comprising a driving component, wherein the driving component is connected with the base, and connected with the movable component, the sequence component, the leg component and the back component by transmission, respectively, the driving component is capable of driving the movable component to move relative to the base, and driving the leg component or the back component to extend or fold relative to the chair bracket, and the leg component is capable of moving in association with the sequence component when driven by the driving component, resulting in controlling the chair bracket to move relative to the movable component along the preset trajectory.

12. The chair of claim 11, further comprising a transmission component, wherein the transmission component comprises a power output member, and the power output member is connected with the driving component and the movable component by transmission, respectively, and pivotally connected with the leg component and the sequence component, and the power output member is capable of driving the leg component to extend or fold relative to the chair bracket when driven by the driving component, and driving the sequence component to move relative to the movable component.

13. The chair of claim 12, wherein the transmission component further comprises a first mechanism of transmission connecting rod and a second mechanism of transmission connecting rod, the first mechanism of transmission connecting rod comprises a first transmission connecting rod, a second transmission connecting rod, a third transmission connecting rod and a fourth transmission connecting rod, the first mechanism of transmission connecting rod is capable of driving the power output member to move when driven by the driving component, resulting in driving the leg component and the sequence component to move, wherein the first transmission connecting rod is pivotally connected with the movable component, and connected with the driving component, two ends of the second transmission connecting rod are pivotally connected with the first transmission connecting rod and the third transmission connecting rod, respectively, and two ends of the fourth transmission connecting rod are pivotally connected with the third transmission connecting rod and the power output member, respectively, the second mechanism of transmission connecting rod comprises a fifth transmission connecting rod and a sixth transmission connecting rod, the second mechanism of transmission connecting rod is capable of driving the movable component to move when driven by the power output member, wherein two ends of the fifth transmission connecting rod are pivotally connected with the power output member and the sixth transmission connecting rod, respectively, an end away from the fifth transmission connecting rod of the sixth transmission connecting rod is pivotally connected with the movable component.

14. The chair of claim 10, wherein a number of the chair frame mechanism is two sets, and the two sets of the chair frame mechanism are symmetrically disposed relative to the base and capable of moving in association with each other.

15. The chair of claim 10, wherein one of the swing controlling element and the chair bracket is provided with a guide groove, the other one of the swing controlling element and the chair bracket is provided with a guide block sliding with the guide groove, and the guide groove is defined as the preset trajectory for the sliding of the guide block.

16. The chair of claim 15, wherein the guide groove comprises a first guide portion and a second guide portion that are communicated with each other, and the guide block is capable of continuously sliding from one of the first guide portion and the second guide portion to the other one of the first guide portion and the second guide portion, in a process of the guide block sliding in the first guide portion, the swing controlling element is capable of controlling the leg component to extend or fold relative to the chair bracket, and controlling the back component to fix relative to the chair bracket, in a process of the guide block sliding in the second guide portion, the swing controlling element is capable of controlling the back component to extend or fold relative to the chair bracket, and controlling the leg component to fix relative to the chair bracket.

17. The chair of claim 16, wherein the first guide portion is in a circular arc shape having a center, which is a pivot point between the swing controlling element and the adjusting mechanism for sitting postures.

18. The chair of claim 17, wherein the second guide portion is in a straight line shape, and the straight line and a pivot point between the swing controlling element and the adjusting mechanism for sitting postures are collinear.

* * * * *